US005713546A

United States Patent [19]

Auspos

[11] Patent Number: 5,713,546

[45] Date of Patent: Feb. 3, 1998

[54] TRAY AND BEVERAGE CONTAINER HOLDER

[76] Inventor: Charles M. Auspos, 116 W. 27th St., Minneapolis, Minn. 55408

[21] Appl. No.: 571,507

[22] Filed: Dec. 13, 1995

[51] Int. Cl.[6] ..... A45F 3/44

[52] U.S. Cl. ..... 248/156; 248/311.2

[58] Field of Search ..... 248/146, 150, 248/156, 311.2

[56] References Cited

U.S. PATENT DOCUMENTS

| | | | |
|---|---|---|---|
| 1,406,893 | 2/1922 | Randall . | |
| 2,603,439 | 7/1952 | Vesconte | 248/156 |
| 2,603,440 | 7/1952 | Vesconte et al. | 248/156 |
| 2,877,828 | 3/1959 | Barnette, Jr. . | |
| 2,899,153 | 8/1959 | Parker . | |
| 2,924,338 | 2/1960 | Sharp . | |
| 4,096,951 | 6/1978 | Menssen . | |
| 4,334,661 | 6/1982 | Pitt . | |
| 4,407,475 | 10/1983 | Gossage . | |
| 4,852,835 | 8/1989 | Ciulli . | |
| 4,889,302 | 12/1989 | Tucker . | |
| 4,927,118 | 5/1990 | Pierorazio . | |
| 5,022,549 | 6/1991 | Beaver . | |
| 5,149,032 | 9/1992 | Jones et al. . | |
| 5,238,211 | 8/1993 | Borovski | 248/311.2 |
| 5,294,083 | 3/1994 | Roth . | |

*Primary Examiner*—Leslie A. Braun
*Assistant Examiner*—Willie Berry, Jr.
*Attorney, Agent, or Firm*—Burd, Bartz & Gutenkauf

[57] ABSTRACT

A foldable holder for beverage containers and other items has a generally horizontal tray provided with a hole for accommodating a beverage container. A U-shaped member pivotally mounted to the tray traverses the bottom of the hole to provide a support for the beverage container and retain the container within the hole of the tray. The tray is supported above the ground with a stake pivotally connected to one end of the tray. The stake can be pivoted into a side-by-side relationship relative to the tray to facilitate the carrying and storage of the holder. The U-shaped member is also pivoted in a generally folded position relative to the tray, so the entire tray is located in a generally common plane.

20 Claims, 4 Drawing Sheets

TRAY AND BEVERAGE CONTAINER HOLDER

FIELD OF THE INVENTION

The invention is in the field of supports for objects, including liquid containers, cans, bottles, food and personal items. The support has an upright stake pivotally connected to a tray and a U-shaped member pivotally connected to the tray to retain a container in the tray.

BACKGROUND OF THE INVENTION

Beverage containers, items of food and personal items, when placed on the ground and sand, become contaminated with dirt and insects which must be cleared before consumption or use. When drink containers are placed on the ground, they can be unstable and difficult to handle. An attempt to overcome these circumstances was made by S. G. Pitt in U.S. Pat. No. 4,334,661 with a drink container mounting ground stake. The stake is connected to a supporting foot and a ring. The foot projects laterally from the stake below the ring. When the stake is inserted into the ground, foot and ring retain the beverage container above the surface of the ground.

SUMMARY OF THE INVENTION

The invention is a foldable holder for beverage containers and other items, such as food, glasses, sun tan lotion, combs, etc. The holder has a tray provided with a hole to accommodate a conventional beverage can or bottle, and a platform extended laterally of the hole. A U-shaped member is pivotally connected to opposite sides of the tray in alignment with the transverse diameter of the hole. The U-shaped member is movable from a folded position in alignment with the tray to a down position below the hole in the tray wherein the U-shaped member is a bottom support for the beverage can container. When the can extends through the hole, it is stable. The tray is held in a horizontal position above the ground with a stake support. A pivot member connects the upper end of the stake to an end of the tray. The stake can be angularly moved about 270 degrees to a folded position on top of the tray. This allows the holder to be transported in a flat configuration and can be placed in a beach bag or garment bag, cooler or pants pocket.

DESCRIPTION OF A PREFERRED EMBODIMENT

Figure 1:
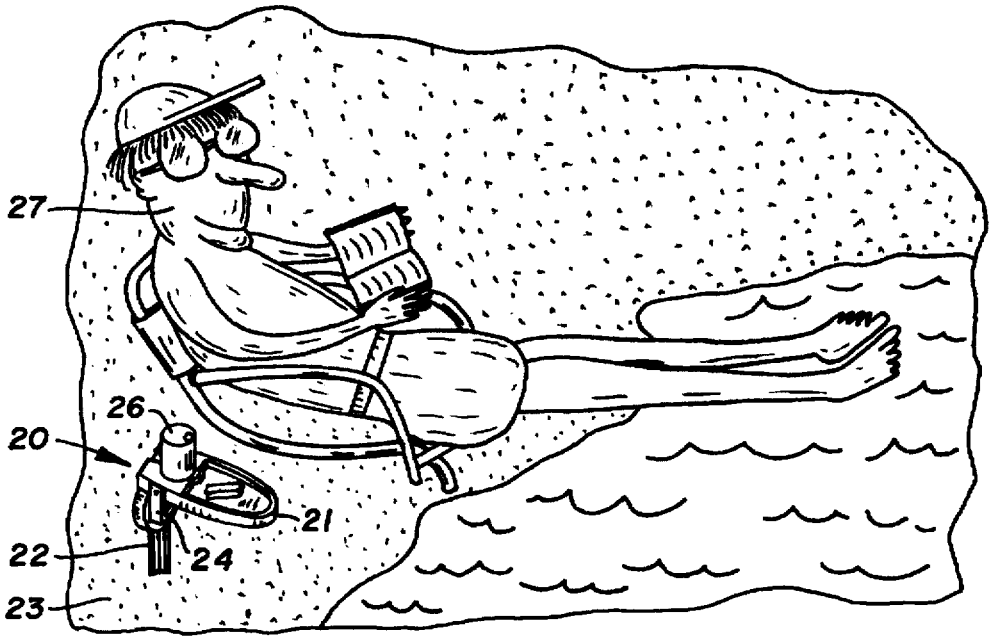
FIG. 1 is a perspective view of the tray and beverage container holder as used in a beach environment.

As shown in FIG. 1, a tray and beverage container holder of the invention, indicated generally at 20, is used in a beach environment to provide access to food and beverages to the person 27 while maintaining the food and a beverage container above the ground or sand 23. Tray and beverage container holder 20 can be used in other environments to support and hold a variety of products in a position where they are accessible to one or more persons.

Tray and beverage container holder 20 has a generally elongated tray or platform 21. One end of tray 21 is connected to an upright support or stake 22 that projects into sand 23 to hold platform 21 in an elevated position adjacent person 27. Tray 21 pivotally supports a U-shaped member 24, located adjacent stake 22. The bottom of U-shaped member 24 supports a container or can 26 for the person's favorite beverage.

Figure 2:
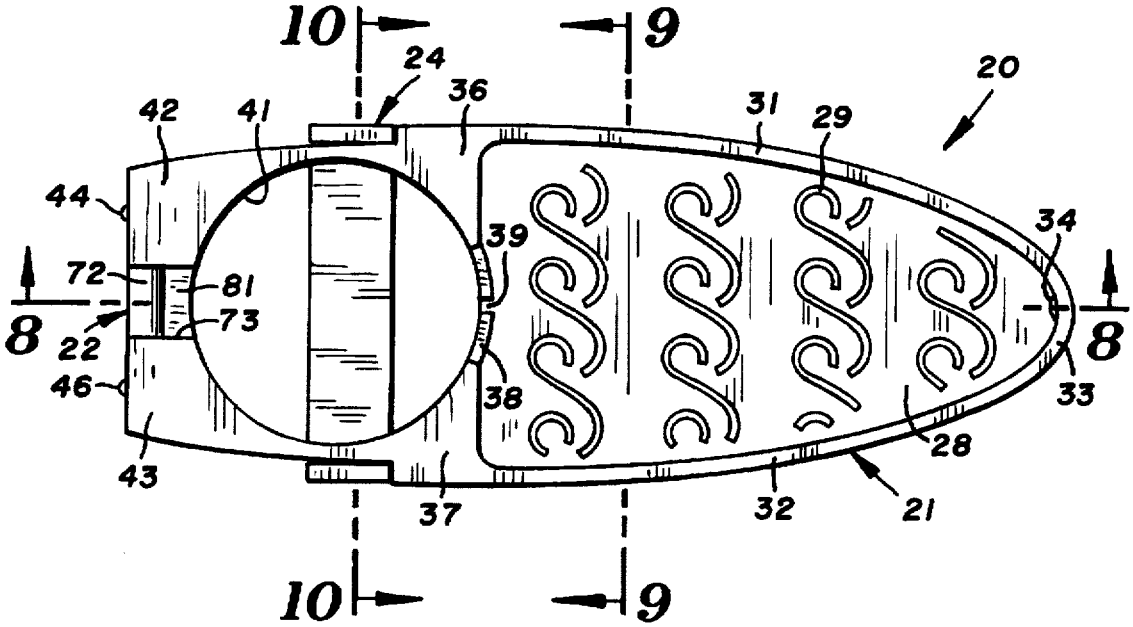
FIG. 2 is an enlarged top plan view thereof.

As shown in FIG. 2, tray 21 has a generally flat base 28 having a convex-curved forward end. Base 28 has a plurality of rows of curved slots 29 to allow water, sand and other particulate material to flow through base 28. Upright side walls 31 and 32 are joined to opposite sides of base 28. Walls 31 and 32 converge forwardly and merge into a convex-shaped nose 33. The mid-section of nose 33 has an inwardly-directed projection or detente 34. Rear portions of side walls 31 and 32 merge with inwardly-directed walls 36 and 37, which are separated from each other by a centrally-located recess 38. The bottom of recess 38 has a downwardly-directed slot 39 longitudinally aligned with detente 34.

A circular hole 41 is located between walls 36 and 37, and back walls 42 and 43. Hole 41 preferably has a diameter slightly larger than the diameter of a metal beverage container or plastic beverage container. A pair of projections 44 and 46 extend rearwardly from back walls 42 and 43.

Figure 3:
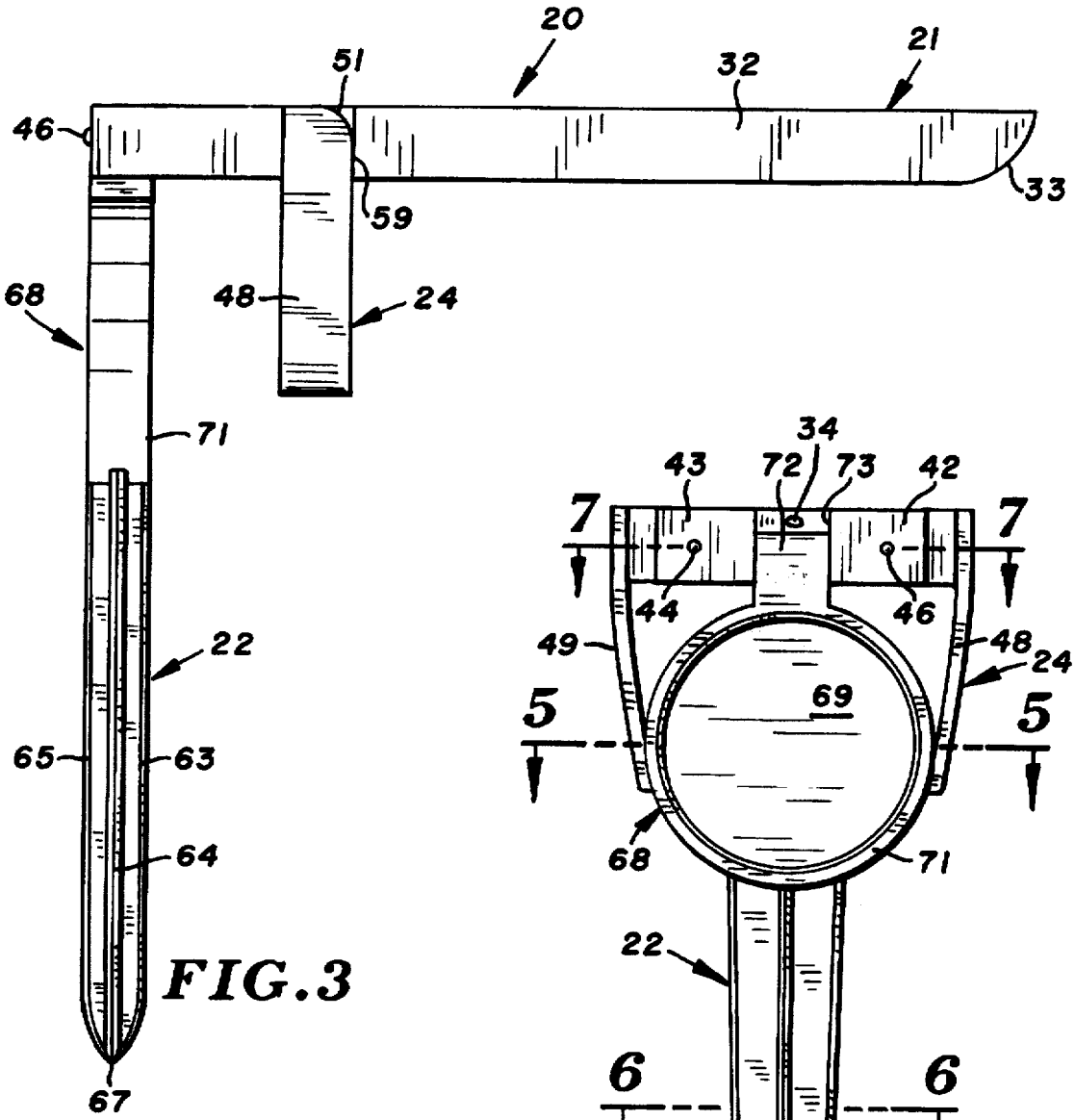
FIG. 3 is a side elevational view thereof.
Figure 8:
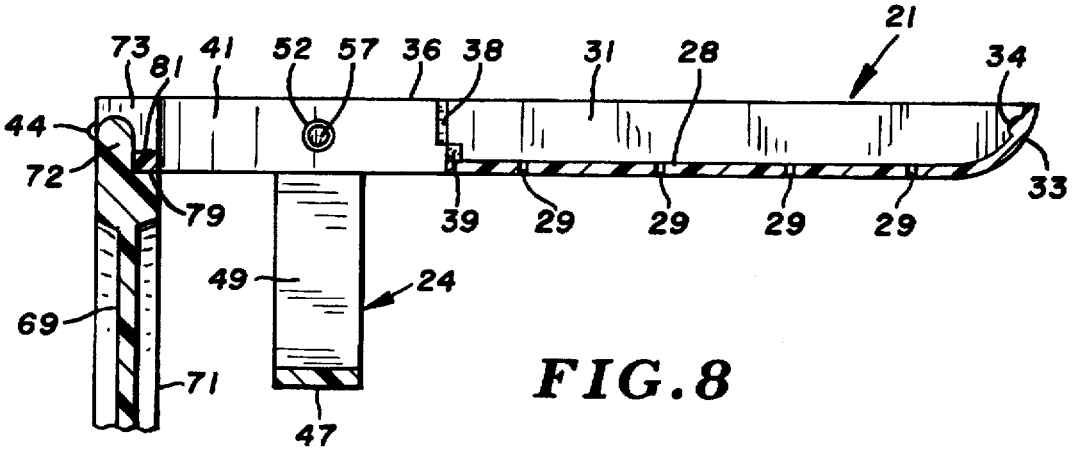
FIG. 8 is a sectional view taken along line 8—8 of FIG. 2.
Figure 9:
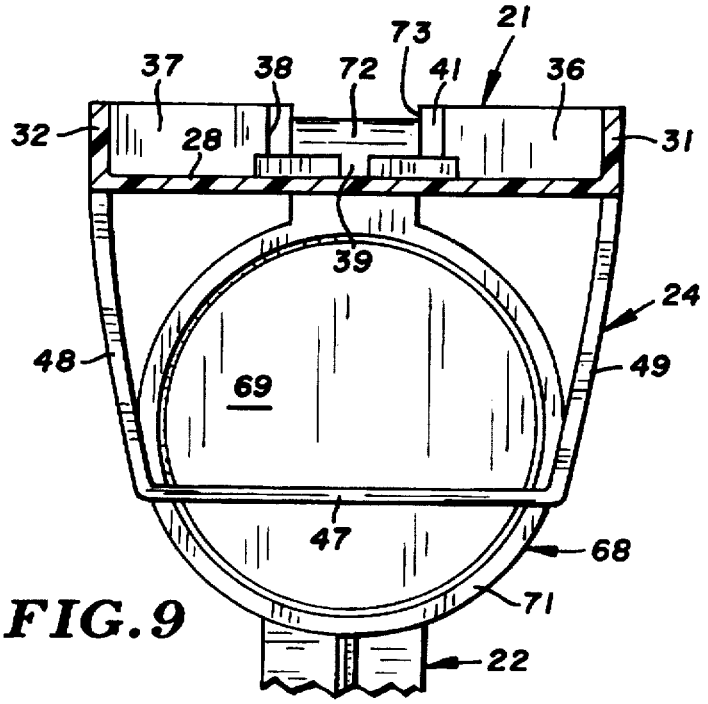
FIG. 9 is a sectional view taken along line 9—9 of FIG. 2.
Figure 10:
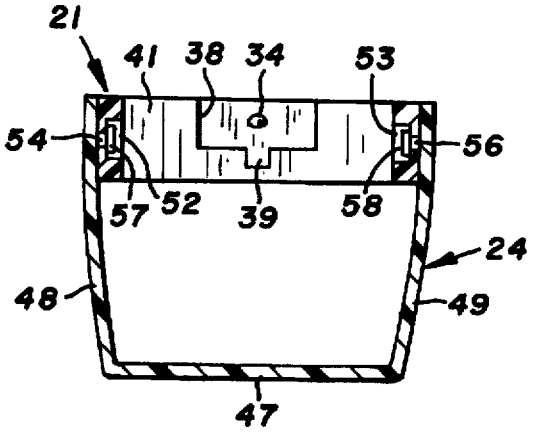
FIG. 10 is a sectional view taken along line 10—10 of FIG. 2.

As shown in FIG. 10, U-shaped member 24 has a generally flat, horizontal base 28 and upwardly-curved side members 48 and 49. The upper ends of members 48 and 49 are located adjacent opposite sides of tray 21. Tray 21 has a pair of counter-sunk holes 52 and 53 that are open to circular hole 41. Pivot bosses 54 and 56, having enlarged heads 57 and 58, are located in holes 52 and 53. Heads 57 and 58 are slightly larger than the small portion of holes 52 and 53 whereby the U-shaped member is pivotally attached to tray 21. Heads 57 and 58 are pressed through holes 52 and 53 to connect U-shaped member 24 to tray 21. U-shaped member 21, when in the down position, engages shoulders 59 on the rear ends of side walls 31 and 32, as seen in FIG. 3. Shoulders 59 hold the U-shaped member in a generally vertical position relative to horizontal tray 21. As seen in FIGS. 2 and 8, U-shaped member 24 is located below hole 41 and provides a bottom support for beverage container 26.

Figure 11:
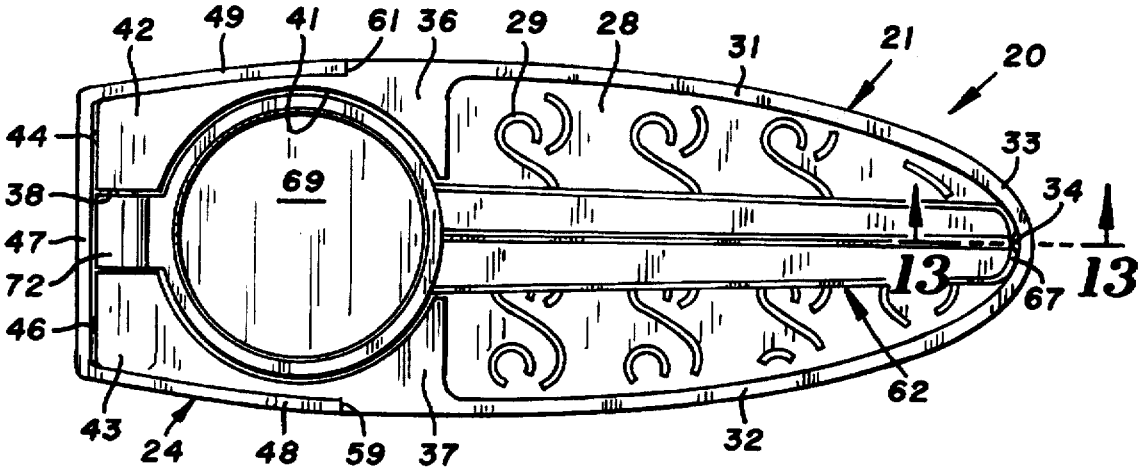
FIG. 11 is a top plan view of the tray and beverage container holder in its folded position.
Figure 12:
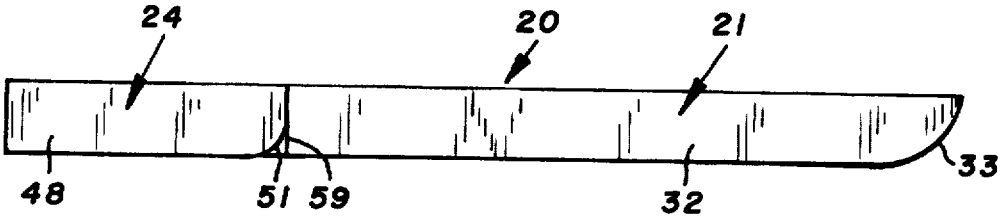
FIG. 12 is a side elevational view of FIG. 11.
Figure 13:
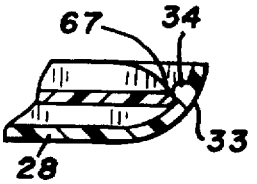
FIG. 13 is an enlarged sectional view taken along line 13—13 of FIG. 11.

Referring to FIGS. 11 and 12, U-shaped member 24 is pivoted upwardly to locate base 47 adjacent back walls 42 and 43. Projections 44 and 46 frictionally engage base 47 to hold U-shaped member 24 in a generally horizontal position aligned with tray 21, as shown in FIG. 12.

Figure 4:
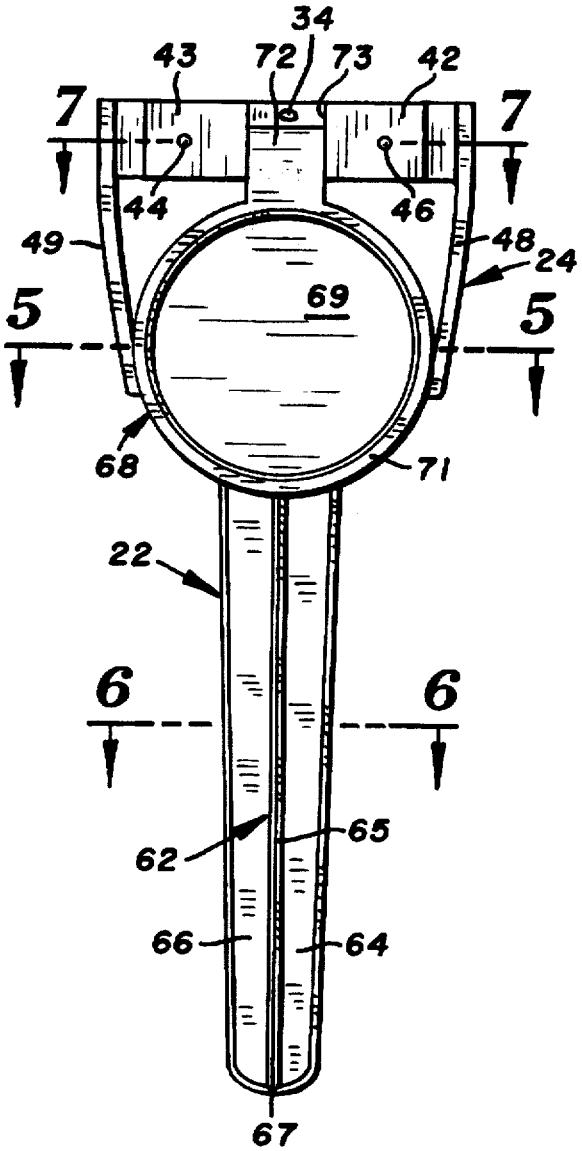
FIG. 4 is an end elevational view of the right end of FIG. 3.
Figure 5:
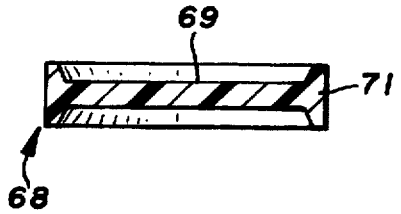
FIG. 5 is an enlarged sectional view taken along the line 5—5 of FIG. 4.
Figure 6:
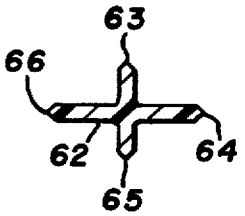
FIG. 6 is an enlarged sectional view taken along the line 6—6 of FIG. 4.

As seen in FIGS. 3 and 4, stake 22 has an elongated, downwardly-directed leg 62 adapted to be projected into sand 23. Leg 62 has linear vertical ribs 63, 64, 65 and 66 normally disposed relative to each other, as seen in FIG. 6. The lower end 67 of leg 62 has a convex-curved shape which merges into ribs 63–66. The upper end of leg 62 is joined to a circular or disc-shaped body 68 having a circular face 69 and an outer peripheral rim 71. Body 68 has a circular configuration that fits into hole 41, as seen in FIG. 10.

Figure 7:
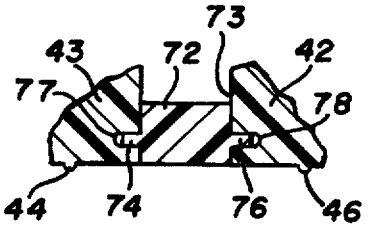
FIG. 7 is an enlarged sectional view taken along the line 7—7 of FIG. 4.

An upwardly-directed head 72 is secured to the top of rim 71. Head 72 fits into a generally upright slot 73 between the rear end walls 42 and 43 of tray 21, as seen in FIG. 2, and is pivotally connected to back walls 42 and 43 of tray 21. As seen in FIG. 7, head 72 has lateral ears 74 and 76 that project into notches or holes 77 and 78 in back walls 42 and 43 of tray 21 to pivotally join stake 22 to tray 21. As seen in FIGS. 2 and 8, tray 21 has a transverse stop 81 joined to and extended between walls 42 and 43. Head 72 has a forwardly-directed shoulder 79 that engages stop 81 when stake 22 is in the generally upright position. The cooperating engagement of shoulder 71 and stop 81 maintains tray 21 in a generally horizontal position when the stake is placed vertically in the sand, ground or other support structure 23.

The tray and beverage container holder 20 is normally stored and carried in the folded position, as shown in FIGS. 11 and 12. Support 22 is folded on top of tray 21. The end 67 of leg 62 is forced under projection 34 to releasably hold support 22 in a general horizontal position within the confines of side walls 31 and 32 on top of platform 28. Circular member 69 fits within hole 41. Head 72 fits within recess 38. U-shaped member 41 is folded upwardly adjacent the rear of back walls 42 and 43 and retain there by projections 44 and 46. Base 47 of U-shaped member 24 has a friction fit relative to projections 44 and 46 thereby retaining U-shaped member 24 in general longitudinal alignment with tray 21. When holder 20 is used in a beach or other environment, as shown in FIG. 1, U-shaped member 24 is folded to a generally normal position relative to tray 21, as seen in FIGS. 8 and 10. Base 47 provides a bottom support for the beverage container to retain the container within the confines of hole 41. Support 22 is then pivoted from a generally horizontal position to the vertical position until shoulder 69 engages stop 81. Leg 62 is then inserted into the ground, such as sand 23. Support 22 holds tray 21 in a generally horizontal position above sand 23.

The tray and beverage container holder 20 can be readily returned to its compact transport position. Leg 62 is removed from the ground and folded onto the back of tray 21. The outer end 67 of leg 62 is forced under projection 34 to hold the leg in generally parallel relationship relative to tray 21. U-shaped member 24 is folded upwardly and retained in back of tray 21 by projections 44 and 46, extended rearwardly from back walls 42 and 43.

Holder 20 comprises three plastic parts comprising tray 21, stake 22 and U-shaped member 24. The plastic of the parts can have different or the same colors. These parts can be made of wood, metal or other materials. Bolts and screws are not used to connect the parts of holer 20. Stake 22 has ears 74 and 76 that are forced into notches in the back of tray 21 to pivotally mount stake 22 on tray 21, as shown in FIG. 7. U-shaped member 24 has a pair of bosses 54 and 56 that are forced through holes 52 and 53 in opposite sides of tray 21 to pivotally mount U-shaped member 24 on tray 21. The size of holder 20 can vary to accommodate the conventional 12-ounce beverage container and the 44-ounce fountain beverage container.

While there has been shown and described a preferred embodiment of the tray and beverage container holder of the invention, it is understood that changes in the shape, structure, materials and arrangement of structure can be made by those skilled in the art without departing from the invention. The invention is defined in the following claims.

I claim:

1. A holder for a beverage container and objects comprising: tray means having a hole for accommodating a beverage container, a platform for supporting at least one object, upright side walls joined to opposite sides of the platform, and a front wall joined to the side walls and platform; a U-shaped member engageable with the container for holding the container in said hole, first pivot means pivotally connecting the U-shaped member to the tray means for movement between a first position generally normal to the tray means and a second position longitudinally aligned with the tray means, Support means for holding the tray means in a generally horizontal position above a surface, second pivot means pivotally connecting the support means to the tray means for movement between a first position generally normal to the tray means to hold the tray means above said surface and a second position adjacent the tray means, and projection means on the front wall engageable with the support means for releasable holding the support means in its second position.

2. The holder of claim 1 wherein: the platform has a plurality of holes.

3. The holder of claim 1 wherein: the tray means includes a recess open to the hole for accommodating a beverage container, notches open to the recess, and a stop member extended across the recess, said support means having a head located in said recess, said second pivot means including projections extended into said notches to pivotally connect the support means to the tray means, and a shoulder engageable with the stop member when the support means is in its first position.

4. The holder of claim 1 wherein: the tray means includes counter-sunk holes adjacent opposite sides of the hole for accommodating a beverage container, and said first pivot means includes pivot bosses extended into the counter-sunk holes thereby pivotally mounting the U-shaped member on the tray means.

5. A holder for a beverage container and objects comprising: tray means having a hole for accommodating a beverage container and a platform for supporting at least one object, a U-shaped member engageable with the container for holding the container in said hole, first pivot means pivotally connecting the U-shaped member to the tray means for movement between a first position generally normal to the tray means and a second position longitudinally aligned with the tray means, support means for holding the tray means in a generally horizontal position above a surface, and second pivot means pivotally connecting the support means to the tray means for movement between a first position generally normal to the tray means to hold the tray means above said surface and a second position adjacent the tray means, said tray means including a recess open to the hole for accommodating a beverage container, notches open to the recess, and a stop member extended across the recess, said support means having a head located in said recess, said second pivot means including projections extended into said notches to pivotally connect the support means to the tray means, and a shoulder engageable with the stop member when the support means is in its first position.

6. The holder of claim 5 wherein: the support means includes a circular body and a leg extended away from the body adapted to be inserted into the ground.

7. The holder of claim 6 wherein: the leg has at least one longitudinal rib.

8. The holder of claim 5 including: means for releasably holding the U-shaped member in its second position.

9. The holder of claim 8 wherein: the means for releasably holding the U-shaped member in its second position comprises at least one projection on the tray means engageable with the U-shaped member located in its second position.

10. A holder for a beverage container comprising: tray means having a hole for accommodating a beverage container, a U-shaped member engageable with the container for holding the container in said hole, first pivot means pivotally connecting the U-shaped member to the tray means for movement between a first position generally normal to the tray means, and a second position longitudinally aligned with the tray means, support means for holding the tray means in a generally horizontal position above a surface, said tray means including a recess open to the hole for accommodating a beverage container, notches open to the recess, and a stop member extended across the recess, said support means having a head located in said recess, said second pivot means including projections extended into said notches to pivotally connect the support means to the tray means, and a shoulder engageable with the stop member when the support means is in its first position.

11. The holder of claim 10 wherein: the tray means includes counter-sunk holes adjacent opposite sides of the hole for accommodating a beverage container, and said pivot means includes pivot bosses extended into the counter-sunk holes thereby pivotally mounting the U-shaped member on the tray means.

12. The holder of claim 10 including: means for releasable holding the U-shaped member in its second position comprising at least one projection on the tray means engageable with the U-shaped member located in its second position.

13. The holder of claim 10 wherein: the support means includes a circular body and a leg extended away from the body adapted to be inserted into the ground.

14. The holder of claim 13 wherein: the leg has at least one longitudinal rib.

15. The holder of claim 10 including: means on the tray means engageable with the support means to releasably hold the support means in a position generally parallel to the tray means.

16. A holder for a beverage container and objects comprising: tray means having a hole for accommodating a beverage container and a platform for supporting at least one object, a U-shaped member engageable with the container for holding the container in said hole, first pivot means pivotally connecting the U-shaped member to the tray means for movement between a first position generally normal to the tray means and a second position longitudinally aligned with the tray means, means for releasably holding the U-shaped member in its second position comprising at least one projection on the tray means engageable with the U-shaped member located in its second position, and support means for holding the tray means in a generally horizontal position above a surface.

17. The holder of claim 16 including: means pivotally connecting the support means to the tray means for movement between a first position generally normal to the tray means to hold the tray means above said surface and a second position adjacent the tray means, and means on the tray means engageable with the support means for releasably holding the support means in its second position.

18. A holder for a beverage container comprising: tray means having a hole for accommodating a beverage container, means for holding the container in said hole, support means for holding the tray means in a generally horizontal position above a surface, said tray means including a recess open to the hole for accommodating a beverage container, notches open to the recess, and a stop member extended across the recess, said support means having a head located in said recess, and projections extended into said notches to pivotally connect the support means to the tray means, and a shoulder engageable with the stop member when the support means is in a position generally normal to the tray means.

19. The holder of claim 18 including: means on the tray means engageable with the support means to releasably hold the support means in a position generally parallel to the tray means.

20. The holder of claim 18 wherein: the support means includes a circular body and a leg extended away from the body adapted to be inserted into the ground, said head being joined to the body.

* * * * *